United States Patent [19]

Khinkis

[11] Patent Number: 5,013,236

[45] Date of Patent: May 7, 1991

[54] ULTRA-LOW POLLUTANT EMISSION COMBUSTION PROCESS AND APPARATUS

[75] Inventor: Mark J. Khinkis, Morton Grove, Ill.

[73] Assignee: Institute of Gas Technology, Chicago, Ill.

[21] Appl. No.: 354,837

[22] Filed: May 22, 1989

[51] Int. Cl.[5] ..... F23C 6/04

[52] U.S. Cl. ..... 431/10; 431/9; 431/351

[58] Field of Search ..... 431/2, 9, 10, 173, 284, 431/351

[56] References Cited

U.S. PATENT DOCUMENTS

| | | | |
|---|---|---|---|
| 3,368,604 | 2/1968 | Mutchler . | |
| 3,567,399 | 3/1971 | Altmann et al. | 431/352 X |
| 3,736,747 | 6/1973 | Warren . | |
| 3,890,084 | 6/1975 | Voorheis et al. | 431/10 |
| 3,915,619 | 10/1975 | Quigg et al. . | |
| 4,021,186 | 5/1977 | Tenner . | |
| 4,112,676 | 9/1978 | DeCorso . | |
| 4,375,949 | 3/1983 | Salooja . | |
| 4,382,771 | 5/1983 | Carr . | |
| 4,385,490 | 5/1983 | Schirmer et al. . | |
| 4,395,223 | 7/1983 | Okigami et al. | 431/10 |
| 4,405,587 | 9/1983 | McGill et al. . | |
| 4,427,362 | 1/1984 | Dykema . | |
| 4,598,553 | 7/1986 | Saito et al. . | |
| 4,651,534 | 3/1987 | Stroem . | |

FOREIGN PATENT DOCUMENTS

| | | | |
|---|---|---|---|
| 0036038 | 4/1978 | Japan | 431/10 |
| 0105328 | 8/1979 | Japan | 431/10 |
| 0091108 | 7/1981 | Japan | 431/10 |

*Primary Examiner*—Carl D. Price

*Attorney, Agent, or Firm*—Thomas W. Speckman; Douglas H. Pauley

[57] ABSTRACT

An apparatus and method for ultra-low pollutant emission combustion of fossil fuel wherein an elongated cyclonic primary combustion chamber has a cross-sectional area about 4 to about 30 percent that of an elongated cyclonic secondary combustion chamber and a volume about 1 to about 20 percent the combined primary and secondary combustion chamber volume. A first fuel portion of about 1 percent to about 20 percent of the total fuel and primary combustion air in an amount selected from about 40 to about 90 percent and about 140 percent to about 230 percent of the stoichiometric requirement for complete combustion of the first fuel portion is introduced into the primary combustion chamber. A second fuel portion of about 80 to about 99 percent of the total fuel is introduced into the secondary combustion chamber with secondary combustion air in an amount of about 150 percent to about 260 percent of the stoichiometric requirement for complete combustion of the fuel. In preferred embodiments cyclonic flow is maintained through the combustor.

32 Claims, 1 Drawing Sheet

ULTRA-LOW POLLUTANT EMISSION COMBUSTION PROCESS AND APPARATUS

BACKGROUND OF THE INVENTION

1. Field of the Invention

The invention relates to an apparatus and process for ultra-low pollutant emission combustion of fossil fuel using a primary combustion chamber with a relatively small amount of fuel and relatively low or high percentage of stoichiometric air requirement and a secondary combustion chamber with a large amount of fuel with excess air, both combustion chambers having cyclonic flow. The secondary combustion chamber is larger than the primary combustion chamber in a specified relation. A dilution chamber may be used. Combustion under these conditions results in ultra-low nitrogen oxides ($NO_x$), carbon monoxide (CO) and total hydrocarbon emissions (THC).

2. Description of the Prior Art

Existing multi-stage combustors use nozzles to mix fuel and air within a combustion chamber and other existing designs use partially premixed fuel and air prior to introducing such fuel/air mixture into a combustion chamber. Other existing combustor designs which use fully premixed fuel and air prior to introducing the fuel/air mixture into a combustion chamber use a one-stage combustion process which does not provide high flame stability at very high excess air.

U.S. Pat. No. 4,112,676 teaches a combustor wherein a small portion of fuel is injected into the upstream end to form a fuel-rich air mixture for diffusion burning. A fuel-lean/air mixture is introduced through a plurality of axially spaced inlets of the burner to result in a series of low temperature premixed flames which provide reduced, thermally formed nitrogen oxide compounds. The '676 patent does not teach cyclonic flow through the combustion chambers.

U.S. Pat. No. 4,598,553 teaches a two-stage gas turbine combustor wherein fuel/air mixture is injected into the upstream combustion chamber from a first-stage swirl burner. The main downstream burner has a plurality of air inlets formed by a plurality of vanes which are disposed in an annular passage to swirl the air. When the flow rate of the supplied fuel is large, the fuel from the air inlets moves from an inner-peripheral surface toward the outer-peripheral surface of the second burner for better mixing.

U.S. Pat. No. 4,382,771 teaches a gas and steam generator having a plurality of progressively larger combustion chambers in communication through restrictive orifices. Fuel and air are introduced at the upstream end of two of three chambers and water is introduced downstream to produce saturated or superheated steam in combination with the products of combustion. The ratio of water to fuel is relatively high.

U.S. Pat. No. 4,385,490 teaches a staged combustor having a first combustion chamber and an adjacent and downstream larger diameter and volume second combustion chamber. All fuel is injected into the upstream end of the first combustion chamber. Air may be supplied tangentially to both combustion chambers reducing nitrogen oxide and carbon monoxide emissions.

U.S. Pat. No. 4,427,362 teaches a combustion method for reducing emissions of nitrogen oxides wherein all fuel is introduced into the first combustion zone with combustion occurring with combustion air in an amount of about 45 percent to 75 percent of the total stoichiometric amount of oxygen required for complete combustion of the fuel. Remaining fuel and combustion products are maintained at a temperature of at least 1800° K. for a time sufficient to reduce the nitrogen oxides content of the mixture to a desired level following which air is added to one or more additional combustion zones for completion of combustion at a temperature of about 1600° K. to 2000° K.

U.S. Pat. No. 3,368,604 teaches a combustion device having two combustion chambers connected by a restriction orifice. All fuel is injected into the first combustion chamber and combustion air is introduced into both combustion chambers.

U.S. Pat. No. 4,651,534 teaches a gas turbine combustor having two stage combustion with all fuel injected at its upstream end. The second stage combustion zone has a larger cross section area than the first. 18 percent of the inlet air is introduced into each of the first and second combustion sections to mix with the fuel; 12 percent and 8 percent of the inlet air is introduced into the first combustion section and second combustion sections, respectively, to generate a swirling cooling flow; and the final 44 percent of the inlet air is introduced into the exhaust section to cool exhaust gases.

U.S Pat. No. 3,915,619 teaches a gas turbine combustor wherein separate streams of air are supplied to primary and secondary combustion zones for removing heat from the primary combustion zone and reintroducing the heat into the combustor at a region spaced downstream from both combustion zones. All of the fuel is introduced at the upstream end of the first combustion zone and into a swirling stream of air so as to effect controlled mixing of the fuel and air.

U.S. Pat. No. 4,021,186 teaches a two stage combustor wherein primary combustion occurs at sub-stoichiometric conditions in a primary combustion chamber. Air is injected at the outlet of the primary combustion chamber in such a manner that the air completely mixes with the flue gases leaving the primary combustion chamber thereby causing secondary combustion to occur within the furnace fire box or, alternatively, within the secondary combustion chamber.

U.S. Pat. No. 3,736,747 teaches a combustor having one combustion chamber with three separate combustion zones within a housing. All fuel is introduced into the upstream end of the first combustion zone and combusted in a fuel-rich flame. The flame is regeneratively cooled by air which swirls to contain and cool the flame.

U.S. Pat. No. 4,375,949 teaches a method of at least partially burning fuel introduced at an upstream end of the first stage of a two stage combustor. Fuel is partially burned in the first stage under conditions which reduce smoke and/or carbon and the partially combusted fuel is then brought into contact with a substantially non-volatile catalyst which is active for reducing the amount of nitrogen oxides in the partially combusted fuel.

U.S. Pat. No. 4,405,587 teaches a process for reducing the concentration of nitrogen oxides in a waste stream by burning with a stoichiometric deficiency of oxygen at a temperature between about 2000° F. and about 3000° F. to provide reducing conditions followed by oxidizing the combustibles present in the combustion effluent.

SUMMARY OF THE INVENTION

It is an object of this invention to provide an apparatus and process for combustion of fossil fuel which produces ultra-low pollutant emissions of nitrogen oxides ($NO_x$), carbon monoxide (CO), and total hydrocarbons (THC). Suitable fossil fuels include natural gas, atomized oils, and pulverized coals, natural gas being preferred.

It is another object of this invention to provide an apparatus and process for combustion of fossil fuel wherein a first stage of combustion burns a first fuel portion from about 1 percent to about 20 percent of the total fuel mixed with primary combustion air in an amount of about 140 percent to about 230 percent of the stoichiometric requirement for complete combustion of the first fuel portion. The second stage of combustion burns any unburned fuel from the primary combustion chamber and an added second fuel portion of about 80 percent to about 99 percent of the total fuel mixed with secondary combustion air in an amount of about 150 percent to about 260 percent of the stoichiometric requirement for complete combustion of the second fuel in the secondary combustion chamber.

In another embodiment, primary combustion air in an amount of about 40 to about 90 percent of the stoichiometric combustion of the first fuel portion is introduced to the primary combustion chamber. The reducing gases from the primary combustion chamber are passed to the secondary combustion chamber.

The apparatus for low pollutant emission combustion of fossil fuel has a first upstream end, a first downstream end and at least one first wall defining an elongated cyclonic primary combustion chamber. A second upstream end, a second downstream end and at least one second wall define an elongated cyclonic secondary combustion chamber. A dilution chamber upstream end, downstream end, and at least one dilution chamber wall define an elongated dilution chamber.

The primary combustion chamber is in communication with the secondary combustion chamber which is in communication with the dilution chamber. The dilution chamber has a discharge outlet in communication with the outside atmosphere, a turbine, or the like.

A first fuel portion inlet nozzle is in communication with the primary combustion chamber for introducing a first fuel portion of about 1 percent to about 20 percent of the total amount of fossil fuel to be combusted in the combustor. Primary combustion air is also introduced through the primary inlet nozzle into the primary combustion chamber in an amount of about 140 percent to about 230 percent of the stoichiometric requirement for complete combustion of the first fuel portion. The primary combustion air and the fuel portion are thoroughly mixed to form a primary fuel/air mixture which is then introduced into the primary combustion chamber. An ignitor is mounted within the primary combustion chamber for igniting the primary fuel/air mixture within the primary combustion chamber. The primary fuel/air mixture is combusted in the primary combustion chamber at about 2000° F. to about 2700° F. thereby producing initial combustion products having ultra-low pollutant emissions. The initial combustion temperature is controlled by the amount of primary combustion air introduced to the primary combustion chamber. In an alternative embodiment, primary combustion air is introduced into the primary combustion chamber in an amount of about 40 to about 90 percent of the stoichiometric requirement for complete combustion of the first fuel portion. Due to the incomplete combustion in the primary combustion chamber, the incomplete combustion products will include non-combusted fuel.

The initial combustion products are introduced into the secondary combustion chamber. A second fuel portion, about 80 to about 99 percent of the total amount of fuel is introduced into the secondary combustion chamber through a secondary inlet nozzle. Secondary combustion air is also introduced through the secondary inlet nozzle into the secondary combustion chamber in an amount of about 150 percent to about 260 percent of the stoichiometric requirement for complete combustion of the fuel introduced to the secondary combustion chamber. The secondary combustion air and second fuel portion are mixed to form a secondary fuel/air mixture which is then introduced into the secondary combustion chamber. The secondary fuel/air mixture is combusted in the secondary combustion chamber at about 1700° F. to about 2600° F. producing final combustion products having ultra-low pollutant emissions. The secondary combustion temperature is controlled by the amount of secondary combustion air introduced to the secondary combustion chamber.

The final combustion products and the initial combustion products are mixed in the secondary combustion chamber to form mixed combustion products which are introduced into the dilution chamber. Dilution air is introduced into the dilution chamber thus producing ultra-low pollutant emission vitiated air at a temperature of about 100° F. to about 2500° F. The ultra-low pollutant emission vitiated air is discharged from the dilution chamber.

In a preferred embodiment of this invention, the primary combustion chamber, secondary combustion chamber and dilution chamber each have an approximately cylindrical shape and are longitudinally aligned. The downstream end of the primary combustion chamber is in communication with the upstream end of the secondary combustion chamber and the downstream end of the secondary combustion chamber is in communication with the upstream end of the dilution chamber.

The cross-sectional area of the primary combustion chamber is about 4 percent to about 30 percent of the cross-sectional area of the secondary combustion chamber. The volume of the primary combustion chamber is about 1 percent to about 20 percent of the total combined volume of the primary and secondary combustion chamber. The volume of the dilution chamber is about 50 percent to about 250 percent of the volume of the secondary combustion chamber.

At least one primary inlet nozzle is tangentially mounted through the first wall of the primary combustion chamber near the upstream end tangentially introducing the fuel and air with respect to the combustion chamber wall. At least one secondary inlet nozzle is tangentially mounted through the second wall near the upstream end of the secondary combustion chamber tangentially introducing the fuel and air with respect to the combustion wall. At least one dilution air inlet nozzle is tangentially mounted through the dilution chamber wall near the dilution chamber upstream end tangentially introducing air with respect to the dilution chamber wall.

In a preferred embodiment of this invention, the primary combustion air and the first fuel portion fed to the primary combustion chamber are thoroughly premixed to form a primary fuel/air mixture prior to introduction into the at east one primary inlet nozzle. It is also preferred to premix the secondary combustion air and the second fuel portion fed to the secondary combustion chamber to form a secondary fuel/air mixture prior to introduction into the at least one secondary inlet nozzle.

In another preferred embodiment according to this invention, the downstream end of the primary combustion chamber may have a first orifice with a diameter less than that of the primary combustion chamber for exhausting initial combustion products from the primary combustion chamber into the secondary combustion chamber.

The downstream end of the secondary combustion chamber may have a second orifice with a diameter less than that of the secondary combustion chamber for exhausting complete combustion products from the secondary combustion chamber into the dilution chamber. The dilution chamber downstream end may have a dilution chamber orifice with a diameter less than that of the dilution chamber for exhausting vitiated air to either the outside atmosphere, a turbine, or the like. The orifices are preferably concentrically aligned with the chambers.

In one embodiment of this invention, at least one primary inlet nozzle may be positioned in the upstream end, axially with respect to the first wall, to introduce fuel and air into the primary combustion chamber.

BRIEF DESCRIPTION OF THE DRAWINGS

The above mentioned and other features of this invention and the manner of obtaining them will become more apparent, and the invention itself will be best understood by reference to the following description of specific embodiments taken in conjunction with the drawings, wherein.

DESCRIPTION OF PREFERRED EMBODIMENTS

Figure 1:
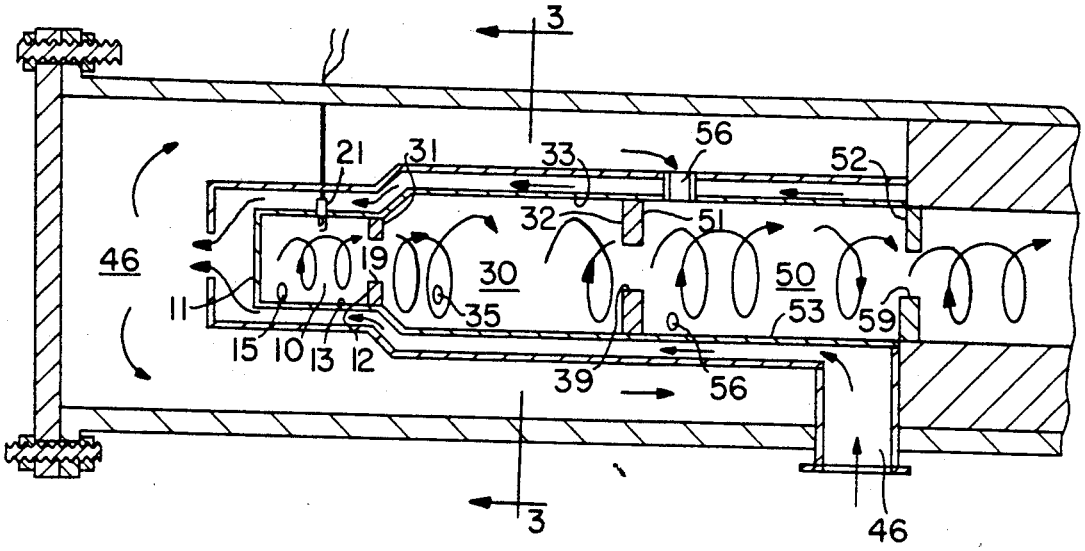
FIG. 1 shows a cross-sectional side view of one embodiment of an apparatus according to this invention for ultra-low pollutant emission combustion of fossil fuel.

FIG. 1 shows a cross-sectional side view of an apparatus for ultra-low pollutant emission combustion of fossil fuel according to one embodiment of this invention. Upstream end 11, downstream end 12 and at least one wall 13 define primary combustion chamber 10. It is apparent that primary combustion chamber 10 can have any suitable cross-sectional shape which allows cyclonic flow, preferably an approximately cylindrical shape.

The first fuel portion of about 1 to about 20 percent of the total amount of fossil fuel to be burned in the combustor is introduced into primary combustion chamber 10 through primary inlet nozzle 15. At least one primary inlet nozzle 15 is tangentially mounted through wall 13, preferably near the upstream end of primary combustion chamber 10 and/or axially mounted through upstream end 11. The term "tangential" refers to a nozzle being attached to the side wall of a chamber in a non-radial position such that flow through the nozzle into the chamber creates cyclonic flow about the centerline of the combustion chamber. A cylindrical shaped combustion chamber best accommodates such cyclonic flow.

Primary air is also introduced through primary inlet nozzle 15 into primary combustion chamber 10 in an amount of about 140 to about 230 percent or about 40 to about 90 percent of the stoichiometric requirement for complete combustion of a first fuel portion within primary combustion chamber 10 providing excess air or substoichiometric air, respectively.

In a preferred embodiment of this invention, downstream end 12 is common with upstream end 31 of secondary combustion chamber 30. Downstream end 12 has orifice 19 with an opening smaller than the cross section of primary combustion chamber 10 which allows initial combustion products to be exhausted from primary combustion chamber 10 into secondary combustion chamber 30. It is apparent that orifice 19 can be positioned at any location in downstream end 12, preferably orifice 19 is concentrically aligned in downstream end 12. It is apparent that orifice 19 can be an orifice plate, a converging nozzle, or the like.

Ignitor 21 is mounted within primary combustion chamber 10. Ignitor 21 provides ignition for the first fuel portion and primary air contained within primary combustion chamber 10. Ignitor 21 can be a spark plug, glow plug, continuous burner, or any other suitable ignition source familiar to the art.

Upstream end 31, downstream end 32 and at least one wall 33 define secondary combustion chamber 30. Secondary combustion chamber 30 can have any cross-sectional shape which provides cyclonic flow through secondary combustion chamber 30, preferably an approximately cylindrical shape.

The second fuel portion of about 80 to about 99 percent of the total fuel is introduced into secondary combustion chamber 30 through secondary inlet nozzle 35. At least one secondary inlet nozzle 35 is tangentially mounted through wall 33, preferably near the upstream end of secondary combustion chamber 30, to provide cyclonic flow.

Secondary combustion air is also introduced through inlet nozzle 35 into secondary combustion chamber 30 in an amount of about 150 percent to about 260 percent of the stoichiometric requirement for complete combustion of the fuel in the secondary combustion chamber. Secondary combustion air may flow through passage 46 into primary and secondary inlet nozzles 15 and 35, respectively.

Downstream end 32 of secondary combustion chamber 30 is common with upstream end 51 of dilution chamber 50. Downstream end 32 has orifice 39 with an opening smaller than the cross section of secondary combustion chamber 30 through which combustion products can be exhausted to dilution chamber 50. Orifice 39 can be positioned at any location in downstream end 32, preferably orifice 39 is concentrically aligned in downstream end 32. Orifice 39 can be an orifice plate, a converging nozzle, or the like.

Upstream end 51, downstream end 52 and at least one wall 53 define dilution chamber 50 in communication with secondary combustion chamber 30. Dilution chamber 50 is also in communication with either the outside atmosphere, a turbine or other expanding device, or the like. Dilution chamber 50 can have any suitable cross-sectional shape which provides cyclonic flow through dilution chamber 50, preferably an approximately cylindrical shape. At least one dilution air inlet nozzle 56 is tangentially mounted through wall 53, preferably near the upstream end of dilution chamber 50.

Downstream end 52 of dilution chamber 50 has orifice 59 with an opening smaller than the cross section of dilution chamber 50 for exhausting vitiated air to the outside atmosphere, a turbine or other expanding device, or the like. Orifice 59 can be positioned at any location in downstream end 52, preferably orifice 59 is concentrically aligned with downstream end 52. Orifice 59 can be an orifice plate, a converging nozzle, or the like.

In a preferred embodiment of this invention, primary combustion chamber 10, secondary combustion chamber 30 and dilution chamber 50 are longitudinally aligned. It is preferred that the cross-sectional area of primary combustion chamber 10 be about 4 percent to about 30 percent of the cross-sectional area of secondary combustion chamber 30. The volume of primary combustion chamber 10 is preferred to be about 1 percent to about 20 percent of the total combined volume of primary combustion chamber 10 and secondary combustion chamber 30. The volume of dilution chamber 50 is preferred to be about 50 percent to about 250 percent of the volume of secondary combustion chamber 30.

In one embodiment according to this invention, primary inlet nozzle 15 is passed through upstream end 11 to provide axial introduction into primary combustion chamber 10.

In the embodiment shown in FIG. 1, primary combustion air and the first fuel portion are thoroughly mixed within primary inlet nozzle 15 to form a primary fuel/air mixture. Likewise, secondary combustion air and the second fuel portion are thoroughly mixed within secondary inlet nozzle 35 to form a secondary fuel/air mixture.

Figure 2:
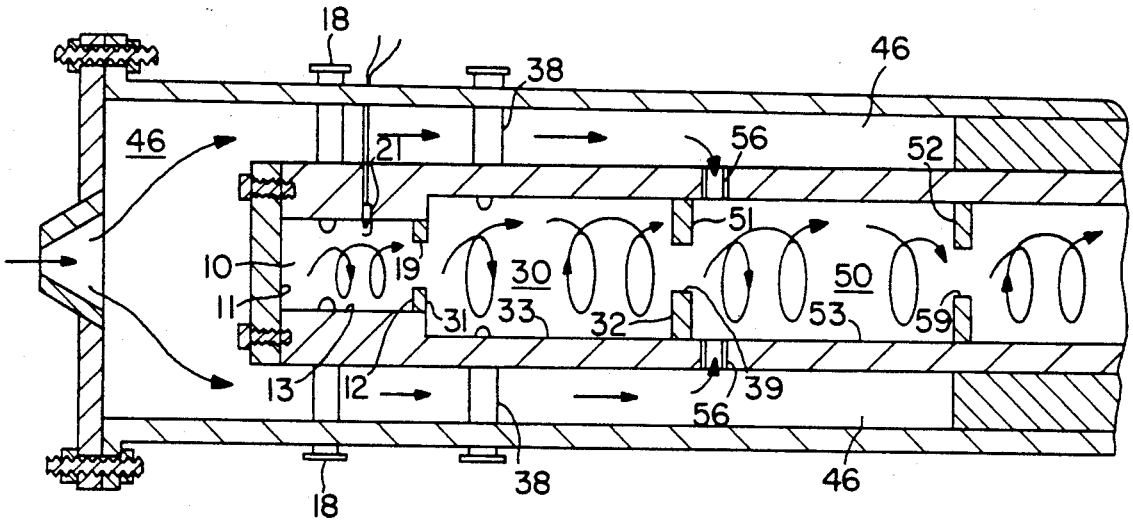
FIG. 2 shows a cross-sectional side view of another embodiment of an apparatus according to this invention for ultra-low pollutant emission combustion of fossil fuel.

FIG. 2 shows a cross-sectional side view of a combustor wherein the primary combustion air and the first fuel portion are thoroughly premixed and the secondary combustion air and the second fuel portion are thoroughly premixed prior to being introduced into primary fuel/air mixture nozzle 18 and fuel/air mixture nozzle 38, respectively. At least one primary fuel/air inlet nozzle 18 is tangentially mounted through wall 13, preferably near the upstream end which provides cyclonic flow through primary combustion chamber 10. At least one secondary fuel/air inlet nozzle 38 is tangentially mounted through wall 13 preferably near the upstream end which provides cyclonic flow through secondary combustion chamber 30.

Figure 3:
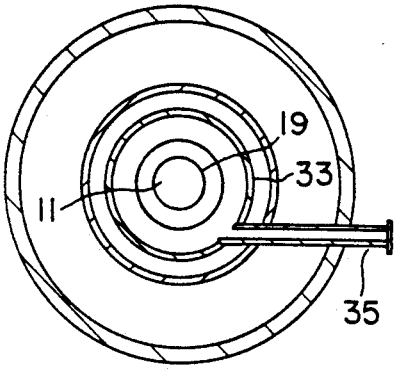
FIG. 3 shows a cross-sectional view taken along line 3—3 as shown in FIG. 1.

FIG. 3 shows a cross-sectional view along line 3—3, as shown in FIG. 1 showing secondary inlet nozzle 35 in the outermost tangential location with respect to wall 33. It is apparent that the term "tangential" applies to any nozzle whose centerline does not intersect with the centerline of the chamber.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An apparatus for ultra-low pollutant emission combustion of fossil fuel comprising:

a first upstream end, a first downstream end and a first wall defining an elongated cyclonic primary combustion chamber, said primary combustion chamber having an elongated cyclonic cross-sectional area about 4 to about 30 percent of the cross-section area of an elongated cyclonic secondary combustion chamber and a volume about 1 to about 20 percent of a combined volume of said primary and secondary combustion chambers;

a second upstream end, a second downstream end and a second wall defining said secondary combustion chamber, said primary combustion chamber in communication with said secondary combustion chamber;

a dilution chamber upstream end, a dilution chamber downstream end and a dilution chamber wall defining an elongated cyclonic dilution chamber, dilution chamber discharge means in communication with said dilution chamber, said secondary combustion chamber in communication with said dilution chamber;

primary inlet means in communication with said primary combustion chamber for introducing a first fuel portion of about 1 percent to about 20 percent of a total amount of the fossil fuel to be burned in the apparatus and for introducing primary combustion air into said primary combustion chamber in an amount selected from one of a first range of about 40 percent to about 90 percent of a first stoichiometric requirement for complete combustion of said first fuel portion and a second range of about 140 percent to about 230 percent of the first stoichiometric requirement for complete combustion of said first fuel portion;

said primary inlet means tangentially mounted with respect to said first wall, ignition means for igniting a mixture of aid first fuel portion and said primary combustion air within said primary combustion chamber;

secondary inlet means in communication with said secondary combustion chamber for introducing a second fuel portion of about 80 percent to about 99 percent of said total amount of the fossil fuel to be burned in the apparatus and for introducing secondary combustion air into said secondary combustion chamber in an amount of about 150 percent to about 260 percent of a second stoichiometric requirement for complete combustion of said second fuel portion;

said secondary inlet means tangentially mounted with respect to said second wall; and dilution air inlet means in communication with said dilution chamber for introducing dilution air into said dilution chamber.

2. An apparatus for ultra-low pollutant emission combustion of fossil fuel according to claim 1 wherein said primary combustion chamber is generally cylindrical.

3. An apparatus for ultra-low pollutant emission combustion of fossil fuel according to claim 2 wherein said primary inlet means are mounted near said first upstream end, and said secondary inlet means are mounted near said second upstream end.

4. An apparatus for ultra-low pollutant emission combustion of fossil fuel according to claim 2 wherein said primary inlet means are axially mounted in said first upstream end.

5. An apparatus for ultra-low pollutant emission combustion of fossil fuel according to claim 2 wherein said secondary combustion chamber is generally cylindrical.

6. An apparatus for ultra-low pollutant emission combustion of fossil fuel according to claim 5 wherein said dilution chamber is generally cylindrical.

7. An apparatus for ultra-low pollutant emission combustion of fossil fuel according to claim 6 wherein dilution air inlet means are tangentially mounted with respect to said dilution chamber wall near said dilution chamber upstream end.

8. An apparatus for ultra-low pollutant emission combustion of fossil fuel according to claim 6 wherein said dilution chamber has a volume equal to about 50 to about 250 percent of the volume of said secondary combustion chamber.

9. An apparatus for ultra-low pollutant emission combustion of fossil fuel according to claim 1 wherein said primary combustion chamber, said secondary combustion chamber, and said dilution chamber are longitudinally aligned.

10. An apparatus for ultra-low pollutant emission combustion of fossil fuel according to claim 1 wherein said first downstream end has a first orifice with a second opening cross-sectional area smaller than a first cross-sectional area of said primary combustion chamber through which initial combustion products are exhausted into said secondary combustion chamber.

11. An apparatus for ultra-low pollutant emission combustion of fossil fuel according to claim 10 wherein said first orifice is concentrically aligned with said first downstream end.

12. An apparatus for ultra-low pollutant emission combustion of fossil fuel according to claim 1 wherein said second downstream end has a second orifice with a second opening cross-sectional area smaller than a second cross-sectional area of said secondary combustion chamber through which complete combustion products are exhausted into said dilution chamber.

13. An apparatus for ultra-low pollutant emission combustion of fossil fuel according to claim 12 wherein said second orifice is concentrically aligned with said second downstream end.

14. An apparatus for ultra-low pollutant emission combustion of fossil fuel according to claim 1 wherein said dilution chamber downstream end has a dilution chamber orifice with a dilution opening cross-sectional area smaller than a dilution cross-sectional area of said dilution chamber.

15. An apparatus for ultra-low pollutant emission combustion of fossil fuel according to claim 14 wherein said dilution chamber orifice is concentrically aligned with said dilution chamber downstream end.

16. An apparatus for ultra-low pollutant emission combustion of fossil fuel according to claim 1 further comprising mixing means for mixing said first fuel portion and said primary combustion air prior to introduction to said primary inlet means.

17. An apparatus for ultra-low pollutant emission combustion of fossil fuel according to claim 1 additionally comprising mixing means for mixing, said second fuel portion and said secondary combustion air prior to introduction to said secondary inlet means.

18. An apparatus for ultra-low pollutant emission combustion of fossil fuel according to claim 1 wherein said primary inlet means provides said primary combustion air in an amount of said first range of about 40 to 90 percent of the first stoichiometric requirement for complete combustion of said first fuel portion resulting in incomplete combustion in said primary combustion chamber.

19. An apparatus for ultra-low pollutant emission combustion of fossil fuel according to claim 1 wherein said primary inlet means provide said primary combustion air in an amount of said second range of about 140 to 230 percent of the first stoichiometric requirement for complete combustion of said first fuel portion in said primary combustion chamber.

20. The method for ultra-low pollutant emission combustion of fossil fuel, the steps comprising:

introducing into a primary combustion chamber a first fuel portion of about 1 percent to about 20 percent of a total fuel to be combusted;

introducing primary combustion air into said primary combustion chamber in an amount selected from one of a first range of about 40 percent to about 90 percent of a first stoichiometric requirement for complete combustion of said first fuel portion and a second range of about 140 percent to about 230 percent of the first stoichiometric requirement for complete combustion of said first fuel portion;

combusting said first fuel portion with said primary combustion air in said primary combustion chamber at a temperature about 2000° F. to about 2700° F. producing initial combustion products;

passing said initial combustion products into a secondary combustion chamber;

introducing into said secondary combustion chamber a second fuel portion of about 80 percent to about 99 percent of the total fuel to be combusted;

introducing secondary combustion air into said secondary combustion chamber in an amount of about 150 percent to about 260 percent of a second stoichiometric requirement for complete combustion of said second fuel portion;

combusting said second fuel portion and any remaining fuel in said initial combustion products with said secondary combustion air in said secondary combustion chamber at a temperature about 1700° F. to about 2600° F. producing final combustion products;

passing said final combustion products into a dilution chamber;

introducing dilution air into said dilution chamber producing ultra-low pollutant emission vitiated air at a temperature about 100° F. to about 2500° F.; and discharging said ultra-low pollutant emission vitiated air from said dilution chamber.

21. The method for combustion of fuel according to claim 20 wherein said primary combustion air is introduced in an amount of said first range of about 40 to about 90 percent of said first stoichiometric requirement resulting in incomplete combustion of said first fuel portion.

22. The method for combustion of fuel according to claim 20 wherein said primary combustion air is introduced in an amount of said second range of about 140 to about 230 percent of said first stoichiometric requirement resulting in complete combustion of said first fuel portion.

23. The method for combustion of fuel according to claim 20 wherein said first fuel portion and said primary combustion air are introduced separately and mixed within primary inlet means.

24. The method for combustion of fuel according to claim 20 wherein said second fuel portion and said secondary combustion air are introduced separately and mixed within secondary inlet means.

25. The method for combustion of fuel according to claim 20 wherein said first fuel portion and said primary combustion air are thoroughly pre-mixed forming a primary fuel/air mixture prior to introducing said primary fuel/air mixture into primary inlet means.

26. The method for combustion of fuel according to claim 20 wherein said second fuel portion and said secondary combustion air are thoroughly pre-mixed forming a secondary fuel/air mixture prior to introducing said secondary fuel/air mixture into secondary inlet means.

27. The method for combustion of fuel according to claim 20 wherein at least a portion of one of said first fuel portion and said primary combustion air is introduced tangentially near an upstream end of said primary combustion chamber.

28. The method for combustion of fuel according to claim 27 wherein a remainder of at least one of said first fuel portion and said primary combustion air is introduced axially into said primary combustion chamber 29. The method for combustion of fuel according to claim 20 wherein at least a portion of one of said second fuel portion and said secondary combustion air is introduced tangentially near an upstream end of said secondary combustion chamber.

30. The method for combustion of fuel according to claim 20 wherein said dilution air is introduced tangentially into said dilution chamber.

31. The method for combustion of fuel according to claim 20 wherein said initial combustion products are passed through a first orifice having a first opening cross-sectional area smaller than a first cross-sectional area of said primary combustion chamber in passing to said secondary combustion chamber.

32. The method for combustion of fuel according to claim 20 wherein said final combustion products are passed through a second orifice having a second opening cross-sectional area smaller than a second cross-sectional area of said secondary combustion chamber in passing to said dilution chamber.

* * * * *